United States Patent [19]

Neuser et al.

[11] 4,181,838

[45] Jan. 1, 1980

[54] ACTUATING MECHANISM WITH AN AUXILIARY SWITCH FOR AN ELECTRICALLY LOCKABLE POWER SWITCH

[75] Inventors: Johannes Neuser, Netphen; Helmut Menzel, Kreuztal-Ferndorf, both of Fed. Rep. of Germany

[73] Assignee: Hundt & Weber Schalgerate GmbH, Freudenberg, Fed. Rep. of Germany

[21] Appl. No.: 895,830

[22] Filed: Apr. 13, 1978

[30] Foreign Application Priority Data

Apr. 19, 1977 [DE] Fed. Rep. of Germany ..... 2717114

[51] Int. Cl.[2] ..... H01H 3/00; H01H 3/20

[52] U.S. Cl. ..... 200/153 LA; 200/153 T; 200/153 G; 200/330

[58] Field of Search ..... 200/153 L, 153 LA, 329, 200/330, 337, 153 G, 68, 70, 77, 153 T

[56] References Cited

U.S. PATENT DOCUMENTS

| | | | |
|---|---|---|---|
| 2,830,154 | 4/1958 | Herrmann et al. | 200/116 |
| 3,171,908 | 3/1965 | Malota | 200/50 |
| 3,246,097 | 4/1966 | Dendy, Jr. et al. | 200/88 |
| 3,852,552 | 12/1974 | Kimijima et al. | 200/153 G |
| 3,858,018 | 12/1974 | Walley | 200/153 LA |
| 3,912,894 | 10/1975 | Mullen et al. | 200/153 LA |

*Primary Examiner*—Steven M. Pollard
*Attorney, Agent, or Firm*—W. A. Elchik

[57] ABSTRACT

An improved actuating mechanism is provided for a power switch that includes a "tripped" position intermediate an "on" position and "off" position. The mechanism includes an auxiliary switch and improved cam operating means for operating the switch.

13 Claims, 2 Drawing Figures

ACTUATING MECHANISM WITH AN AUXILIARY SWITCH FOR AN ELECTRICALLY LOCKABLE POWER SWITCH

CROSS REFERENCE TO RELATED APPLICATIONS

Priority rights of the German patent application No. P27 17 114.8, filed Apr. 19, 1977, upon which this application is based, are claimed.

The power switch disclosed herein is more specifically described in the copending application Ser. No. 895,821, now U.S. Pat. No. 4,151,395, filed concurrently herewith.

BACKGROUND OF THE INVENTION

The invention concerns an actuating mechanism for an electrically lockable power switch, and especially a switch with three switching positions, namely a switch-on position, a switch-off position and a release (or trip) position between them.

With certain electrical circuits, it is advantageous and also very often specified that the power switch interrupts the circuit when certain characteristic values are exceeded or fallen below. For example, the power switch can be made to trip and thus cause the circuit to be interrupted when the network voltage becomes too high or too low. Thus, in the event of short circuits, tripping of the power switch and hence opening of its power contacts can be effected when a short occurs in the circuit. In addition, a prolonged but small overloading of the circuit can also be used to trip the power switch by employing suitable thermal sensors.

In the majority of presently employed power switches, the actuating lever of the power switch is caused to spring back by an internal circuit (or control), not into its switch-off position but into a so-called release or trip position which lies between the switch-on and switch-off positions and usually close to the switch-on position. This intermediate position gives an indication to the servicing personnel that the switching-off of the power switch was not caused from the outside, but was caused by some fault or other. An advantage of this type of intermediate position also resides in the fact that the switch cannot be immediately switched on again from this intermediate position. Rather, the switching lever must first be moved into its off position before it can be moved again into the on position. By this means, it is possible to prevent unintentional switching-on from the tripped position. Return of the switching lever to the switch-off position also increases the switch-on distance, which is frequently employed to preset the tripping mechanism.

Auxiliary switches are frequently incorporated in power switches of this type for additional control and measuring purposes, it being possible with such auxiliary switches, for example, to signal the setting of the power switch at a remote monitoring station. It is also possible electrically to lock the power switch by means of such auxiliary switches, that is, switching the power circuit contacts in or out cannot, for example, be effected even when the switching lever is actuated.

It is often specified, for reasons of safety, that the auxiliary circuit should also not carry voltage when the power switch is tripped and is therefore switched-off, that is, the auxiliary circuit must be switched-off bipolarly. On the other hand, it should not be possible to switch the power switch on again without the auxiliary switch closing the protective circuit.

The objective of the invention is to create an actuating mechanism or device of the above-mentioned type whereby, on the one hand, the auxiliary switches are capable of interrupting the auxiliary circuit when the power switch is tripped while, on the other hand, it is possible quickly in advance to close or open the circuit by a small actuation of the switching handle in order by this means, for example, to release the electrical lock.

SUMMARY OF THE INVENTION

The objective is attained in accordance with the invention by arranging that the actuating mechanism of the above-mentioned type is characterized by the provision of a sliding cam which is retained in a slide-bearing, the arrangement being such that the said cam can be engaged via several stop-faces by a "nose" actuated by the switch mechanism, the arrangement also being such that the sliding cam and the nose can move apart against the force of a spring to such an extend that a change in the engagement of the nose takes place according to the positions of the sliding cam and the nose and the direction of motion of the switching mechanism, the objective of the invention also being attained by the provision of an auxiliary switch which lies in the electric locking circuit and which is actuated by a cam face on the sliding cam.

This arrangement ensures that, when actuating the switching handle, the contacts of the auxiliary switch are initially closed or opened before the contacts of the power switch are actuated, so that no undesirable delay occurs in actuating the power switch due to the auxiliary switching circuit. To this end, it is possible to render the auxiliary switching circuit also voltless when the power switch is tripped without thereby impairing the operation of the power switch.

Other advantageous forms of construction in accordance with the invention are described in the subclaims. In this connection, the actuating mechanism made in accordance with the invention is universally applicable, both for power switches fitted with a rocking lever (or toggle) or a sliding lever, and is also suitable for power switches fitted with a rotary drive. The actuating mechanism can itself be actuated by a rocking lever or with a rotary lever (turn-handle). However, a combination which is especially interesting is one in which a power switch which is actuated by a rocking lever (or toggle) incorporates an actuating mechanism which is provided with a rotary grip.

DESCRIPTION OF THE INVENTION

Figure 1:
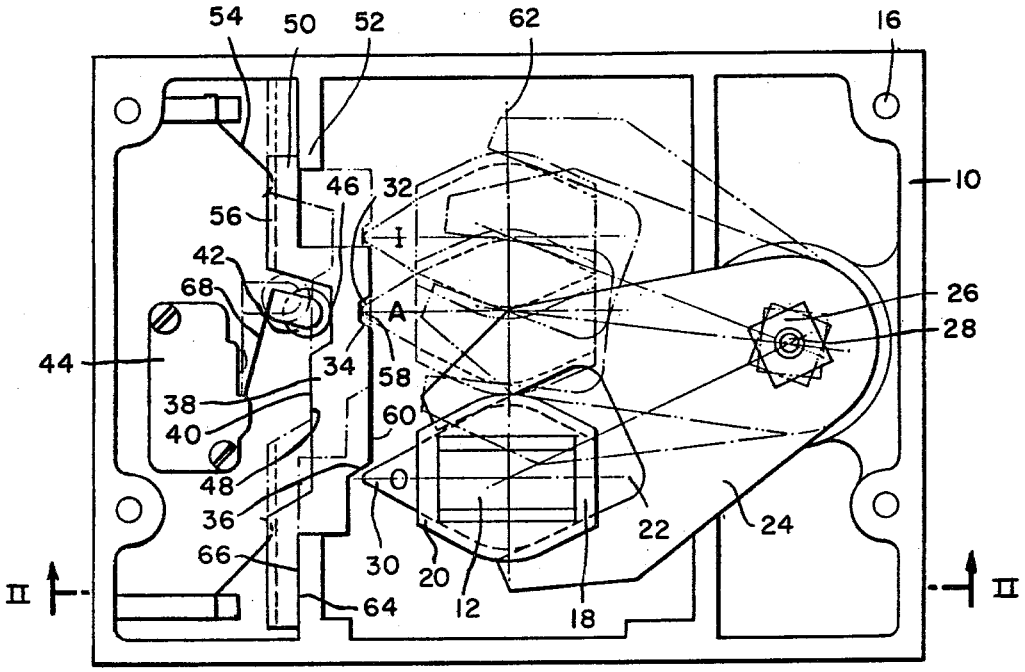
FIG. 1 shows a plan-view from below of a form of construction of the actuating mechanism made in accordance with the invention.
Figure 2:
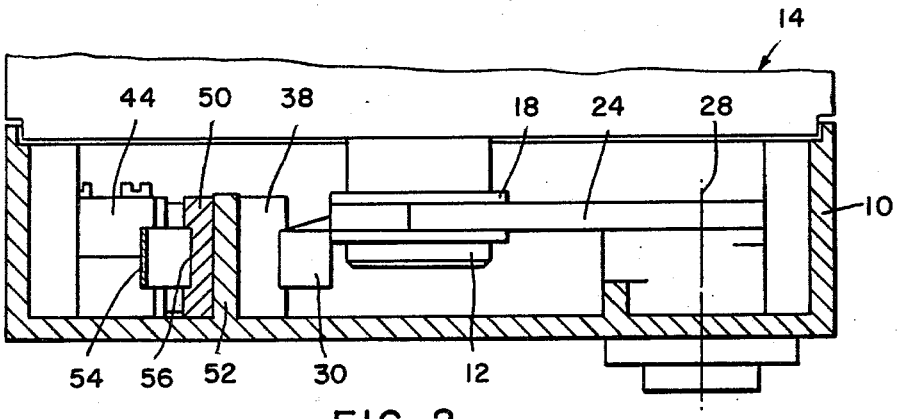
FIG. 2 shows a cross-section of the arrangement shown in FIG. 1 taken in the direction of the arrows A—B.

FIG. 1 shows an especially satisfactory form of construction of the mechanism made in accordance with the invention. The mechanism shown consists of a housing 10 which, in the present case, is screwed on to a power switch 14 by means of screws 16. The power switch 14 can be actuated by means of a rocking lever (or toggle) 12.

With the form of construction shown, the rocking or translatory motion of rocking lever 12 should be converted into a rotational motion which, in many cases, is more advantageous. For this purpose, mounted on rocking lever 12 is a coupling member 18 which is provided with a peripheral groove into which engages the mouth 22 of a fork-shaped lever 24. The said fork-shaped lever 24 is rigidly attached by means of a square-sectioned member 26 to a rotational shaft 28. Shaft 28 passes outwards through a bearing in housing 10 and terminates in a rotatable hand-grip. As a result of the joint action of the coupling member 18 and the forked lever 24, the rotary motion of the hand-grip is converted into a translationed motion which actuates rocking lever 12 of the power switch. The motion-converting device illustrated, which consists of only two components, is especially low in friction because the force-transmitting components only make point or knife-edge contact with each other. This feature is described in the parallel patent application (P 27 17 113.7-Trans).

Coupling member 18 is provided with a nose 30 which acts on a sliding cam-plate 38 via stop-faces 32, 34, 36. Located on the opposite side of sliding cam 38 is a cam-face 40 on which runs the glide-roller 42 of a contact switch 44. Cam face 40 has a shape which is specified by the particular switching function required. In the form of construction shown, switch 44 has two switching positions and cam face 40 is provided with two corresponding plane switching surfaces 46, 48 whose cross-sectional profiles are so chosen that switch 44 is always set in one of its two switching positions, depending on which surface glide-roller 42 is located.

Sliding cam 38 is supported so that it can slide parallel to planes 46 and 48. The support for cam 38 can be provided in a simple manner by providing cam 38 with suitable terminations 50 which abut against projections 52 within housing 10. The said terminations 50 are pressed against the projections by means of springs 54, where the said springs can consist of leaf-springs which, for better control, slide in a groove 56 in the terminations.

Stop-faces 32 and 34 are formed by recesses 58 located in sliding cam 38, while the third stop-face 36 consists of a sloping step. Located between recess 58 and the sloping step 36 is a slide-path 60 along which can slide nose 30. The depth of recess 58 can be made appreciably smaller than the difference in height between planes 46 and 48.

The arrangement of the stop-faces 32, 34 and 36, and hence the length of slide path 60, depends on the position taken by nose 30 at the three possible positions of rocking lever 12 belonging to power switch 14. with the form of construction shown, rocking lever 12 can assume the positions I, A and 0, where I is the switch-on position and 0 is the switch-off position of the power switch. The intermediate position A is the trip position, that is, the position taken by rocking lever 12 when it is released by internal processes.

The actuating mechanism with the form of construction in accordance with the invention functions as follows:

It is assumed that the power switch is in the switched-off setting. This is the setting indicated by the full lines in FIG. 1. In this setting, nose 30 is located against stop-face 36 while sliding-cam 38 lies against its lower stop. Roller 42 of switch 44 lies on the lower plane 46 so that the said switch is in one of its switching positions in which, for example, two auxiliary contacts are opened. In this case, a bipolar interruption of an auxiliary circuit would take place so that the said auxiliary circuit would be potential-free. If the mechanism's rotary handgrip is now so actuated that forked-lever 24 swings upward, coupling member 18 is caused to move upwards along the direction of the straight line 62. During this upward movement, nose 30 moves sliding cam 38 along with it by applying pressure on stop-face 36 until any further sliding movement of the cam is no longer possible due to projection 52 acting as a stop. During this movement of the cam, the roller belonging to auxiliary switch 44 is lifted from plane 46 to plane 48 as a result of which switch 44 is put into its other switching position whereby, for example, the auxiliary circuit is closed. This setting of sliding cam 38 and roller 42 is indicated in FIG. 1 by the broken lines.

With further upward movement of nose 30, the latter pushes sliding cam 38 away from itself against the force of spring 54, as a result of which, the tip of nose 30 moves off stop-face 36 and slides upwards on slide-surface 60 until finally rocking-lever 12 has reached its switch-on position, in which position nose 30 of coupling member 18 will have reached recess 58 and click into it. Springs 54 can now push sliding-cam 38 back again into its rest position in which the bearing surface of end-piece 64 lies against the bearing surface of projection 66 and the bearing surface of end-piece 50 lies against that of projection 52. Auxiliary switch 44 with its roller 42 is so constructed that it is able to accept the additional deflection of the roller while nose 30 is sliding along slide-track 60, without any alteration in its switching position. For this purpose, auxiliary switching lever 68 which carries roller 42 can, for example, be made from a flexible leaf-spring.

The above-described sequence of movements is thus such that switch 44 located in the auxiliary circuit is switched on before the power switch also arrives in its switch-on setting as a result of the movement of rocking lever 12. Were this not the case, if the power switch were to reach its switch-on position before switch 44 in the auxiliary circuit, tripping would immediately occur and, as a result, the power switch would switch-off.

Rocking lever 12 will move into trip position A should power switch 14 be tripped as the result of some fault such as, for example, a disconnection in the auxiliary circuit which would, for example, occur when an over-voltage or under-voltage is present, or as the result of a short circuit or overload of long duration. During this movement, sliding cam 38 can follow the movement of nose 30 because the amount of space provided for the motion of the cam is chosen big enough to allow for the movement of the nose from position I to position A. Consequently, nose 30 remains in recess 58. As a result of the displacement of cam 38 into its lower stop position—see the continuous lines in FIG. 1—roller 42 again arrives on the deep plane 46, as a result of which, switch 44 arrives at its other switching position at which, for example, the auxiliary circuit is again interrupted and is potential-free.

In order, after tripping, to bring the power switch back again into the switched-on setting, it is first necessary for rocking-lever 12 to be taken back again to the switched-off setting (0). Because, with nose 30 in the tripping setting, sliding cam 38 already rests against the lower stop which here, also, can be formed by the corresponding projection 52, a downward movement of the nose out of position A into position 0 can only take place if the tip of nose 30 comes out again from recess 58 and slides downwards along the slide-path 60 until finally the position 0 is reached at which nose 30 abuts against stop-face 36. If, in order to switch-on the power switch, the rocking lever 12 of the said power switch is again moved upward, the sliding cam 36 is again carried upward, as already described, and as a result, auxiliary switch 44 is first actuated so that the auxiliary circuit is switched on before the power switch is itself switched on, as a result of which no premature tripping of the power switch can take place, due to an open auxiliary circuit, when the said power switch is being switched-on.

Should it be unnecessary to convert the translatory motion of rocking-lever 12 into a rotational motion, it is possible to dispense with fork-lever 24 and its bearing 28 and instead provide in housing 10 a slot through which passes a correspondingly longer rocking lever 12.

In the event that a standardized power switch should be used, the coupling member 18 could be designed as an attachment which could be firmly clamped on to rocking lever 12, the attachment being provided with an extension which passes outwards through the slot and by means of which the power switch could be actuated.

On the other hand, if a power switch is employed which is already fitted with a rotary drive mechanism (or rotary grip), the shaft or this drive mechanism could be joined on to forked-lever 24. Alternatively, lever 24 could be provided with a nose 30, so that coupling member 18 could then be eliminated. The additional axial motion caused by the rotational movement could be directly taken-up by springs 54.

Finally, it is even conceivable to convert the rotary drive mechanism of a power switch into a thrust-drive, since, for the coupling member with its lever which extends through a suitable slot in housing 10, there is provided a corresponding slide-bearing in said housing 10.

We claim:

1. An actuating mechanism for an electrically lockable power switch and, more especially, a mechanism with a switching lever which has three switching positions, namely a switch-on position, a switch-off position and a release or tripping position which lies between them, the mechanism being characterized by the incorporation of a sliding cam (38) which is retained by a slide bearing (64) and which can be put into operative engagement, via a number of stop faces (32, 34, 36) with a nose (30) which is moved by a switch-actuating mechanism (12), as a result of which the sliding cam (38) can be moved by the nose (30) away from the slide bearing (64) against the force of a spring (54) such that a change in the operative engagement of the nose (30) takes place according to the position of the sliding cam (38) and the nose (30) and the direction of motion of the switch-actuating mechanism (12), and an auxiliary switch (44) which lies in the electric locking circuit and which is actuated by a cam face (40) of the said sliding cam (38).

2. An actuating mechanism in accordance with claim 1 and which is so characterized that the stop faces (32, 34, 36) of the recesses located on one side of the sliding cam and edges, and the cam face (40) on the opposite side of the sliding cam (38) are formed from a sliding surface consisting of curved parts.

3. An actuating mechanism in accordance with claim 1 and which is so characterized that the sliding cam (38) is mounted in such a way as to be able to slide between the slide bearing surface (64) of the drive mechanism's housing (10), lying on the side of the stop faces, and the spring (54) adjacent the side of the cam face (40).

4. An actuating mechanism in accordance with claim 3 and which is so characterized that the sliding cam (38) consists of a central portion, which is provided with the stop and cam faces (32, 34, 36, 40), and the end parts (60) which are provided with the bearing surfaces (66).

5. An actuating mechanism in accordance with claim 1 and which is so characterized that on the stop-face (32, 34, 36)-side of the sliding cam (38) is provided a slide track (60) for the nose (30), the track being bounded on the one side by a recess (58) and, on the other side, by a sloping step (36), the arrangement being such that the stop faces (32, 34, 36) are formed on the two sides of the recess (58) and the sloping surface (36) of the step.

6. An actuating mechanism, in accordance with claim 5, and which is so characterized that the slide-bearing associated with the cam (38) enables the cam to slide between two positions which correspond to the positions of the nose (30) when the power switch (14) is switched on (I) or released (tripped) (A), when the nose (30) is located in the recess (58).

7. An actuating mechanism in accordance with claim 5 and which is so characterized that the length of the slide path (69) of the nose (30) corresponds to the length of the travel track of the nose (30) when switching the power-switch (14) from the released (tripped) state (A) to the switched-off (0) state.

8. An actuating mechanism in accordance with claim 1 and which is so characterized that the auxiliary switch (44) is provided with two switching positions and operates in conjunction with the cam surface (40) in such a way that when the sliding cam (38) has slid into either of its two end positions, the auxiliary switch is in another switching position, the arrangement being such that one end-position corresponds to the switched-on state (I) and the other end position corresponds to the released (tripped) state (A) and to the switched-off state of the power switch (14).

9. An actuating mechanism in accordance with claim 8 and which is so characterized that the power switch (14) is provided with a rocking lever (toggle).

10. An actuating mechanism in accordance with claim 8 and which is so characterized that the power switch (14) is provided with a rotating lever (or grip).

11. An actuating mechanism in accordance with claim 10 and which is so characterized that the actuating mechanism is a rotary drive.

12. An actuating mechanism in accordance with claim 10 and which is so characterized that the mechanism is a sliding device.

13. An actuating mechanism in accordance with claim 12 and which is so characterized that the actuating mechanism is an attachment to a standard switch.

* * * * *